US005287963A

United States Patent [19]

Umemoto

[11] Patent Number: 5,287,963

[45] Date of Patent: Feb. 22, 1994

[54] ICE ENCLOSURE

[76] Inventor: Tosh Umemoto, 5321 S. Campbell Rd., Wapato, Wash. 98951

[21] Appl. No.: 747,528

[22] Filed: Aug. 20, 1991

[51] Int. Cl.[5] ..... B65D 85/672

[52] U.S. Cl. ..... 206/386; 206/821; 229/3.1

[58] Field of Search ..... 206/322, 386, 597, 600, 206/821; 229/3.1, DIG. 11

[56] References Cited

U.S. PATENT DOCUMENTS

| | | | |
|---|---|---|---|
| 2,489,054 | 11/1949 | Sprolle | 206/386 |
| 2,620,117 | 12/1952 | Nemoede | 206/386 |
| 2,675,123 | 4/1954 | Baird | 229/3.1 |
| 3,142,431 | 7/1964 | Noble | 229/3.1 |
| 3,212,697 | 10/1965 | Anderson | 229/3.1 |
| 3,261,532 | 7/1966 | Davis | 206/600 |
| 3,863,831 | 2/1975 | Wozniacki et al. | 229/DIG. 11 |
| 3,902,651 | 9/1975 | Marshall | 229/3.1 |
| 3,929,536 | 12/1975 | Maughan | 229/3.1 |
| 4,042,127 | 8/1977 | Brossia | 206/386 |
| 4,089,417 | 5/1978 | Osborne | 206/600 |
| 4,211,324 | 7/1980 | Ohlbach | 229/DIG. 11 |
| 4,244,472 | 1/1981 | Brown | 206/597 |
| 4,913,290 | 4/1990 | de Groot | 206/821 |
| 4,976,353 | 12/1990 | Halliday | 206/386 |

*Primary Examiner*—David T. Fidei
*Attorney, Agent, or Firm*—George A. Cashman

[57] ABSTRACT

An ice enclosure for stapling on to the top layer of a stack or pallet load of packed cartons of produce comprises an enclosure formed of cardboard or corrugated board, and having vertical walls, each wall having a horizontal tab extending outward for stapling to the top layer of cartons.

7 Claims, 1 Drawing Sheet

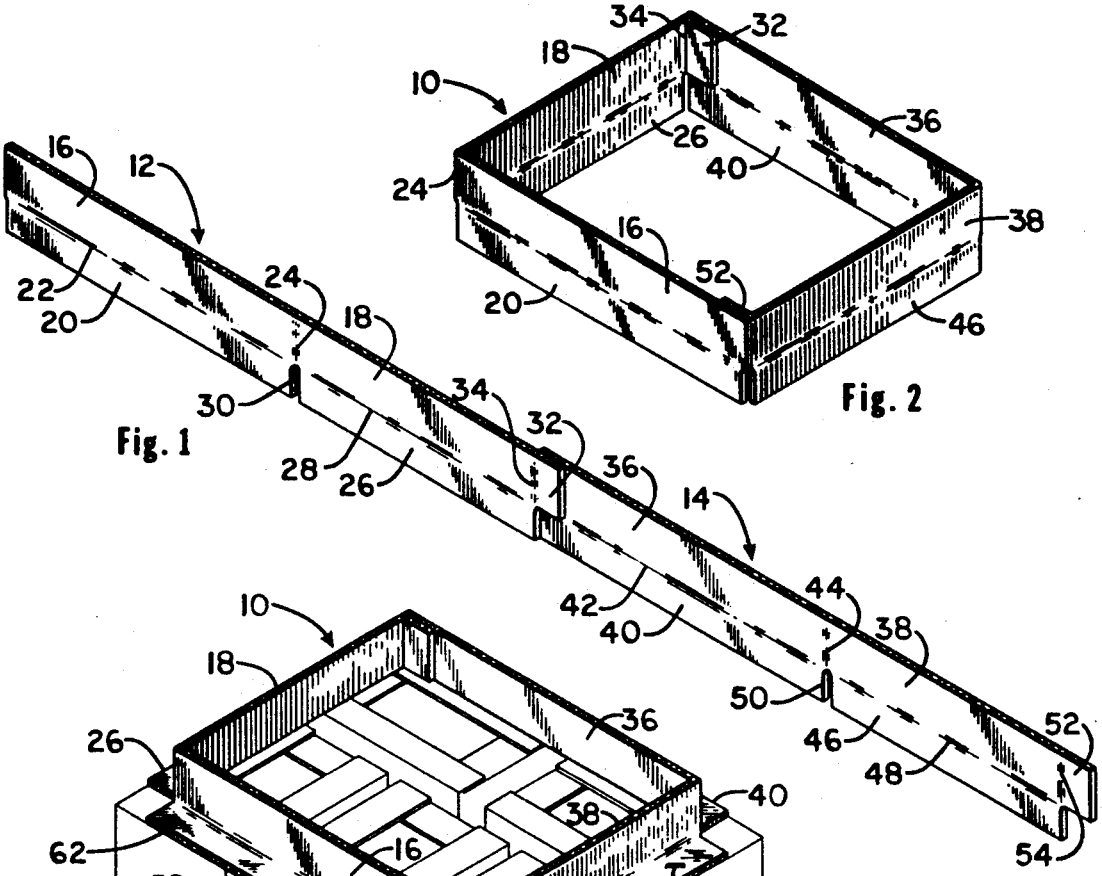
Fig. 1
Fig. 2
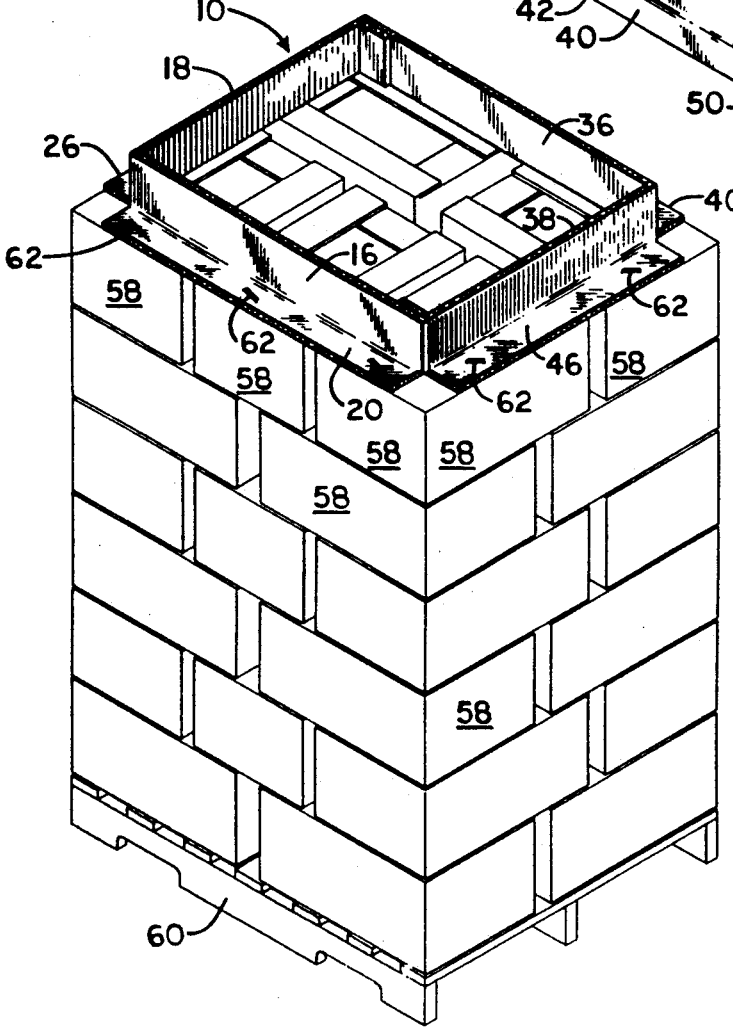
Fig. 3

ICE ENCLOSURE

BACKGROUND OF THE INVENTION

Freshly picked vegetables, when produced and harvested in commercial quantities, need to be cooled quickly and kept cool. As an example, table corn, or sweet corn, needs to be chilled immediately after harvesting, and must be kept below 50° F. so that the sugar in the corn does not turn to starch. On the packing line, the ears of corn may be subjected to a chilled water spray before being packed in cartons. The cartons themselves do not have a completely covered top or bottom; that is, the flaps do not extend half way across the top and bottom, as they do with most other cartons. Instead, there is a rectangular open area at the top, and at the bottom. When a packed carton of corn is placed on a pallet, a mound of crushed ice may be placed over the open area at the top of each carton. The fully loaded pallet is then placed in a chilled warehouse to await shipment. In the warehouse, the ice gradually melts and flows down through each box, assisting in keeping the produce cool. The cartons are made of water-resistant material, such as waxed or plastic-coated cardboard or corrugated board, for example, so that the melting ice does not affect the structural integrity of the carton. In addition, the size of the cartons is such that the cartons, within each layer on the pallet, do not touch each other, but are spaced apart, so that the chilled air in the storage area may circulate between the cartons, thus keeping the product cold.

It is an object of this invention is to simplify and speed up the pallet loading process by providing for a one-time application of crushed ice to the top of the pallet load.

It is a further object of this invention to provide a more stable pallet load by eliminating the individual mounds of crushed ice on the top of each carton, and securing the top layer of cartons in their proper positions.

BRIEF DESCRIPTION OF THE INVENTION

The ice enclosure comprises a vertical fence of water resistant material secured to the top of the pallet load of produce cartons. The fence is kept in place by horizontal tabs which extend to the outer edges of a pallet load of vegetable cartons, and which are stapled to the tops of the top layer of cartons on the pallet.

DESCRIPTION OF THE DRAWINGS

FIG. 1 illustrates the ice enclosure in a partially manufactured condition.

FIG. 2 illustrates the ice enclosure as manufactured.

FIG. 3 ilustrates the ice enclosure in use.

DESCRIPTION OF THE PREFERRED EMBODIMENT

The ice enclosure, generally indicated as 10, is shown in FIG. 1 in a partially assembled condition. While the enclosure 10 may be manufactured of a single strip of cardboard or corrugated board, the figures illustrate an enclosure manufactured of two strips of corrugated board. The two strips are indicated generally by 12 and 14. Strips 12 and 14 are identical. Strip 12 comprises wall-shaped element 16 and wall-shaped element 18. Adjacent to element 16 is stapling tab 20, which is separated from element 16 by fold crease 22. Element 16 is separated from element 18 by fold crease 24. Adjacent to element 18 is stapling tab 26, which is separated from element 18 by fold crease 28, and from stapling tab 20 by notch 30. Connector tab 32, which is of the same width as element 18, extends from the free end of element 18 as illustrated, and is separated from element 18 by fold crease 34.

Strip 14 comprises wall-shaped element 36 and wall-shaped element 38. Adjacent to element 36 is stapling tab 40, which is separated from element 36 by fold crease 42. Element 36 is separated from element 38 by fold crease 44. Adjacent to element 38 is stapling tab 46, which is separated from element 38 by fold crease 48, and from stapling tab 40 by notch 50. Connector tab 52, which is of the same width as element 38, extends from the free end of element 38 as illustrated, and is separated fom element 38 by fold crease 54.

The ice enclosure 10, as completely assembled, is illustrated in FIG. 2. Connector tab 32 is glued, stapled or otherwise attached to element 36 in the position illustrated. Strip 12 is folded at fold crease 24 and at fold crease 34. Strip 14 is folded at fold crease 44 and at fold crease 54. Connector tab 52 is glued, stapled or otherwise attached to element 16 as illustrated, completing the ice enclosure 10.

After assembly, the ice enclosure 10 may be treated with transparent wax or transparent plastic for water resistance.

The ice enclosure 10 in use is illustrated in FIG. 3. Stapling tabs 20, 26, 40 and 46 are folded outward so as to be approximately perpendicular to elements 16, 18, 36 and 38 respectively. The ice enclosure is then placed on the top layer of packed cartons 58 on pallet 60, and stapled thereto with staples 62 so that, preferably, ice enclosure 10 will be attached to each of the cartons in the top layer by at least one staple. The precise locations of the staples 62 are not otherwise important. After ice enclosure 10 is stapled to the top layer of cartons 58, ice, preferably crushed ice, may be placed within the enclosure by any appropriate means, such as shoveling, for example. The ice will gradually melt, and the resulting cold water will trickle down through the cartons 58 on pallet 60, and through the produce contained in the cartons 58.

Ice enclosure 10 is preferably sized to the pallet. For example, if the pallet in FIG. 3 is 40 inches (101.6 cm) by 48 inches (121.9 cm) in plan view, and it is desired to have stapling tabs 4 inches (10.2 cm) wide, then elements 16 and 36 should be 40 inches (101.6 cm) in length, and elements 18 and 38 should be 32 inches (81.3 cm) in length.

Examination of FIGS. 1 and 2 will show that the assembled ice container 10 may be folded flat for shipping and storage.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

I claim:

1. An ice enclosure for securement atop a stack or pallet load of packed cartons of produce comprising:

a plurality of vertically-oriented rectangular planar elements, each element having an upper edge and a lower edge, and the elements being joined successively at their vertical sides to form an enclosure; and each element having a tab extending horizontally outward from its lower edge.

2. The enclosure of claim 1 wherein the material of which the enclosure is manufactured is cardboard.

3. The enclosure of claim 1 wherein the material of which the enclosure is manufactured is corrugated board.

4. The enclosure of claim 2 wherein the material of which the enclosure is manufactured is treated to achieve water resistance.

5. The enclosure of claim 3 wherein the material of which the enclosure is manufactured is treated to achieve water resistance.

6. The enclosure of claim 1 wherein the number of wall-shaped elements is four.

7. The enclosure of claim 6 wherein the shape of the enclosure is a rectangle.

* * * * *